US006523465B1

(12) United States Patent
Kayser

(10) Patent No.: US 6,523,465 B1
(45) Date of Patent: Feb. 25, 2003

(54) PROCESS FOR PRESETTING A CALENDER AND CALENDER FOR IMPLEMENTING THE PROCESS

(75) Inventor: Franz Kayser, Geldem (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 216 days.

(21) Appl. No.: 09/644,239

(22) Filed: Aug. 23, 2000

(30) Foreign Application Priority Data

Aug. 27, 1999 (DE) ..... 199 40 664

(51) Int. Cl.[7] ..... B30B 13/00; B30B 15/16
(52) U.S. Cl. ..... 100/35; 100/162 B; 100/47
(58) Field of Search ..... 100/35, 47, 162 B, 100/170; 72/10.7, 13.4, 11.9

(56) References Cited

U.S. PATENT DOCUMENTS

| | | | | | |
|---|---|---|---|---|---|
| 4,472,958 | A | * | 9/1984 | Biondetti | 100/162 B |
| 4,480,459 | A | * | 11/1984 | Feldman et al. | 100/162 B |
| 4,597,275 | A | * | 7/1986 | Schneid et al. | 72/21 |
| 4,821,544 | A | * | 4/1989 | Tamler et al. | 72/16 |
| 4,989,431 | A | | 2/1991 | Stotz | |
| 5,558,013 | A | * | 9/1996 | Blackstone, Jr. | 100/35 |

FOREIGN PATENT DOCUMENTS

| | | |
|---|---|---|
| DE | 3338625 | 5/1985 |
| DE | 69217603 | 2/1997 |
| WO | 98/24969 | 6/1998 |

* cited by examiner

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

A process for presetting a calender for a material web and a calender. The calender includes a roll stack having at least a first nip and a second nip arranged to define a stack plane and comprising a sag compensation lower roll having a rotationally secured carrier which can be moved along the stack plane by external support devices arranged at both ends of the lower roll, the lower roll having a jacket which is supported on the carrier by internal support devices wherein the jacket can be adjusted along its entire length in the direction of the stack, the calender further comprising at least one middle roll which can be adjusted in the stack plane and a sag compensation upper roll having a carrier which is held stationary at its ends and a jacket which supported on the carrier by internal support devices, the jacket being mounted to the carrier at its ends. The process includes applying pressure to the internal support devices of the lower roll such that the jacket of the lower roll approximately forms a cylinder having a horizontal axis, applying pressure to close each of the first and second nips, the pressure being applied to one of the external support devices of the lower roll and the internal support devices of the lower roll, and recording the pressures on at least one of the internal support devices of the upper roll, the internal support devices of the lower roll, and the external support devices of the lower roll at an instant of a complete closing of the first nip.

16 Claims, 1 Drawing Sheet

PROCESS FOR PRESETTING A CALENDER AND CALENDER FOR IMPLEMENTING THE PROCESS

CROSS-REFERENCE TO RELATED APPLICATIONS

The present application claims priority under 35 U.S.C. §119 of German Patent Application No. 199 40 664.2, filed on Aug. 27, 1999, the disclosure of which is expressly incorporated by reference herein in its entirety.

BACKGROUND OF THE INVENTION

1. Field of the Invention

The invention relates to a process for presetting a calender for a material web such as paper, cardboard, and the like. The calender has a roll stack comprising a lower roll designed as a sag compensation roll. This lower roll is rotationally secured via a carrier which can be lifted in the direction of the stack by utilizing external support devices which grip its ends. The lower roll also has a jacket which is supported on the carrier by internal support devices and the roll can be adjusted along its entire length in the direction of the stack. The calender also includes at least one middle roll which can be adjusted in the direction of the stack. Moreover, an upper roll, designed as a sag compensation roll is also utilized. The upper roll has a carrier which is held stationary at its ends and utilizes a jacket supported on the carrier by internal support devices. This upper roll is also seated on the carrier at its ends. The invention also relates to a calender for implementing this process.

2. Discussion of Background Information

Conventional calenders must be calibrated or preset before they can be loaded for a specific purpose. The aim of calibration is to produce a "straight" nip between the rolls in each case, i.e., for the rolls to lie against each other so as to have the same pressure across the entire calender width, i.e., in order to create a uniform line load in the nip.

One conventional procedure requires calculating a load from the following determinations; internal pressure in the upper roll, the upper roll jacket weight, the middle roll weight, the lower roll jacket weight, and any friction values in the calender, and that the pressures to be applied to the external and internal support devices. The accuracy of the settings were then checked by testing a nip impression using NCR paper. Such a procedure is laborious and time-consuming because even slight deviations between the actual quantities and the calculated quantities lead to deviations in the line load. Moreover, when corrections are made on the basis of nip impression tests, one is never quite certain whether the pressures should be changed overall or whether a mere zone correction should be undertaken. Further, the procedure also has an element of danger because the NCR paper must typically be pushed into the nip by hand.

SUMMARY OF THE INVENTION

The present invention provides for the presetting or calibration of the calender. Accordingly, the present invention provides a process for presetting a calender including a stack comprising a lower roll designed as a sag compensation roll. The lower roll is rotationally secured via a carrier which can be lifted in the direction of the stack by external support devices gripping its ends. A roll jacket is supported on the carrier by internal support devices wherein the roll can be adjusted along its entire length in the direction of the stack. The calender also has at least one middle roll which can be adjusted in the direction of the stack and an upper roll designed as a sag compensation roll. The upper roll has a carrier which is held stationary at its ends and whose jacket is supported on the carrier by internal support devices. The upper roll is also seated on the carrier at its ends. Moreover, pressure can be applied to the internal support devices of the lower roll such that the jacket of the lower roll forms approximately a cylinder with a horizontal axis. Accordingly, in closing the nips, the external support devices of the lower roll or its internal support devices are loaded with an increasing pressure. The process also provides that pressures acting in the external and internal support devices at the instant of the complete closing of the uppermost nip are recorded.

Accordingly, if a calender is utilized whose upper roll is a sag compensation roll without a jacket lift and whose lower roll is a sag compensation roll with a jacket lift, wherein the carriers of the upper roll are held stationary and the height of the carriers of the lower roll are made adjustable by external support devices, the presetting can be performed in a very simple manner. When the jacket of the lower roll corresponds to a cylinder having a horizontal axis, as a result of its loading, and maintains this shape while the nip is being closed due to pressure tracking, corresponding cylindrical shape is formed by a jacket of the upper roll at the instant of the complete closing of the uppermost nip. As a result, straight nips can be obtained in the entire roll stack. Moreover, the pressures acting at this instant can correspond to the basic setting and, building on this, the operating pressure values can be set.

In addition, the uppermost nip can be first closed in the center and thereafter closed progressively towards its sides. According to this design, it is only necessary to observe the closing conditions of the nip at one or both ends and this enables a very precise setting.

According to this process, it is possible that when the calender is put into operation or when the loads are changed (e.g., when a roll is changed), the upper and lower roll pressures of the calender can be calibrated by a single closing.

By tracking the pressure, e.g., the pressure applied to the one support devices of the lower roll is followed to the pressure applied to the other support devices, the provides that the carriers and jacket of the lower roll maintain their correlation to one another.

Moreover, the closing of the uppermost nip can be effected not only by loading the external or internal support devices of the lower roll with an increasing pressure, but also by decreasing the equal pressures applied to the internal support devices of the upper roll, e.g., the pressure applied to the internal support devices of the upper roll is decreased to close the uppermost nip.

However, the application of equal pressure can yield the best results, e.g., wherein approximately equal pressure is applied respectively to the correlated internal and external support devices.

The calibrating procedure can also be carried out automatically, e.g., wherein the pressures are automatically changed until a measuring signal detecting the instant of the complete closing of the uppermost nip occurs.

Optical detection of the nip closing may also be particularly favorable, e.g., such that the instant of the complete closing of the uppermost nip is detected optically.

Additional measures may be advisable for tracking the lower roll, e.g., such as those relating to the pressures applied to the internal support devices of the lower roll can be changed so that the distance between the jacket ends and the carrier remains constant. Moreover, the projecting weights of the middle rolls can also be compensated for in the usual manner.

The calender for implementing the process of the invention may include a roll stack including a lower roll designed as a sag compensation roll, whose rotationally secured carrier can be lifted by external support devices gripping its ends. The lower roll may have a jacket which is supported on the carrier in the direction of the stack by internal support devices such that the lower roll can be adjusted along its entire length in the direction of the stack. The calender can include at least one middle roll which can be adjusted in the direction of the stack and an upper roll designed as a sag compensation roll. The upper roll can have a carrier and be held stationary at its ends and may include a jacket supported on the carrier by internal support devices. The jacket can be seated on the carrier at its ends. Such a calender is particularly suited for carrying out the process described above. Moreover, the calender can include, in the area of at least the one end of the uppermost nip, a measuring device which delivers a closing signal when this nip end closes.

The measuring device may be situated at precisely the point at which the uppermost nip finally closes, so that it is possible to determine the instant of closing very precisely. An optical measuring device may also be provided since such a device has proven to be particularly good in this connection. The measuring device can may also particularly utilize a light barrier, e.g., such as one which is interrupted when the nip end closes. The recording device may also be included for the purpose of documenting the base setting automatically, e.g., such as one which can record the pressures applied to the external and internal support devices that are in effect when the closing signal (S) occurs. Further, the calender can include a favorable arrangement for the tracking of the lower roll, e.g., a control device can be provided for the pressures to be applied to the internal or external support devices of the lower roll so as to keep the distance between the jacket ends and the carrier constant.

According to one aspect of the invention, there is provided a process for presetting a calender for a material web, the calender including a roll stack having at least a first nip and a second nip arranged to define a stack plane and comprising a sag compensation lower roll having a rotationally secured carrier which can be moved along the stack plane by external support devices arranged at both ends of the lower roll, the lower roll having a jacket which is supported on the carrier by internal support devices wherein the jacket can be adjusted along its entire length in the direction of the stack, the calender further comprising at least one middle roll which can be adjusted in the stack plane and a sag compensation upper roll having a carrier which is held stationary at its ends and a jacket which supported on the carrier by internal support devices, the jacket being mounted to the carrier at its ends, the process comprising applying pressure to the internal support devices of the lower roll such that the jacket of the lower roll approximately forms a cylinder having a horizontal axis, applying pressure to close each of the first and second nips, the pressure being applied to one of the external support devices of the lower roll and the internal support devices of the lower roll, and recording the pressures on at least one of the internal support devices of the upper roll, the internal support devices of the lower roll, and the external support devices of the lower roll at an instant of a complete closing of the first nip. The material web may be one of a paper web and a cardboard web and wherein the stack plane is a vertical stack plane with the first nip being arranged above the second nip.

The process may further comprise recording the pressures in each of the internal support devices of the upper roll, the internal support devices of the lower roll, and the external support devices of the lower roll at the instant of the complete closing of the first nip. The pressure applied to the support devices of the lower roll may be followed to the pressure applied to the other support devices. The process may include applying pressure to the internal support devices of the lower roll and thereafter applying pressure to at least one of the internal support devices of the upper roll and the external support devices of the lower roll. The process may further comprise decreasing the pressure applied to the internal support devices of the upper roll in order to close the first nip. The process may further comprise applying approximately equal pressure to each of the internal support devices of the upper roll, the internal support devices of the lower roll, and the external support devices of the lower roll. The approximately equal pressures may be correlated between each of the internal and external support devices. The process may further comprise detecting a measuring signal the instant the first nip is closed. The process may further comprise changing at least one pressure of the external and internal support devices based upon the detecting. The changing may comprise automatically changing the pressure when a measuring signal is detected. The process may further comprise detecting the closing of the first nip using an optical device. The detecting may comprise optically detecting at the instant of a complete closing of the first nip. The process may further comprise changing the pressure applied to the internal support devices of the lower roll in order to produce a constant distance between jacket ends of the lower roll and the carrier of the lower roll. The process may further comprise compensating for a projecting weight of the at least one middle roll.

The invention also provides for a calender for a material web comprising a roll stack defining a stack plane and comprising at least a first and a second nip formed by at least upper and lower sag compensation lower rolls with at least one middle roll disposed between the upper and lower rolls, the lower roll being rotationally secured on a carrier having ends, the carrier being moveable along die stack plane by external support devices arranged at the ends, the lower roll including a jacket which is supported on the carrier by internal support devices which can be adjusted along substantially an entire length of the lower roll, the at least one middle roll being adjustable along the stack plane, the upper roll including a carrier having ends which are held stationary and including a jacket supported on the carrier by internal support devices, the jacket having ends which are mounted on the carrier, and at least one measuring device arranged adjacent an area of at least one end of the first nip, wherein the measuring device produces a closing signal S when the first nip closes.

The material web may be one of a paper web and a cardboard web and wherein the stack plane is a vertical stack plane with the first nip being arranged above the second nip. The at least one measuring device may comprise an optical measuring device. The optical measuring device may include a light barrier which is interruptible when an end of the first nip closes. Each of the external and internal support devices may be operable via hydraulic pressure. The hydraulic pressure in at least one of the external and internal support devices may be changed as a result of the closing signal S. The calender may further comprise a recording device for recording pressures in one of the external and internal support devices. The calender may further comprise a control device for regulating pressures to the internal or external support devices. The control device may be adapted to maintain a constant distance between the jacket ends and the carrier of the lower roll.

The invention also provides for a calender for a material web comprising a roll stack defining a stack plane and comprising at least a first and a second nip formed by at least first and second sag compensation rolls with at least one middle roll disposed between the first and second rolls, the first roll comprising a stationary carrier and a jacket supported on the carrier by internal support devices, the jacket being rotatably mounted on the stationary carrier, the at least one middle roll being adjustably moveable along the stack lane, the second roll comprising an adjustably moveable carrier and a jacket supported on the carrier by internal support devices, the carrier being moveable along the stack plane by external support devices, and at least one measuring device arranged to detect the closing of the first nip, wherein the measuring device produces a closing signal S when the first nip closes.

The invention also relates to a process of presetting a calender for a material web using a calender including a roll stack defining a stack plane and comprising at least a first and a second nip formed by at least first and second sag compensation rolls with at least one middle roll disposed between the first and second rolls, the first roll comprising a stationary carrier and a jacket supported on the carrier by internal support devices, the jacket being rotatably mounted on the stationary carrier, the at least one middle roll being adjustably moveable along the stack plane, the second roll comprising an adjustably moveable carrier and a jacket supported on the carrier by internal support devices, the carrier being moveable along the stack plane by external support devices, and at least one measuring device arranged to detect the closing of the first nip, wherein the measuring device produces a closing signal S when the first nip closes, the process comprising applying pressure to the internal support devices of the second roll such that the jacket of the second roll assumes approximately a cylindrical shape, applying at least one of pressure to the external support devices and additional pressure to the internal support devices of the second roll in order to cause the second roll to contact the at least one middle roll, applying at least one of additional pressure to one of the external support devices and the internal support devices of the second roll, wherein the additional pressure causes movement of the at least one middle roll against the first roll such that the center of the middle roll contacts the center of the first roll before the ends of the middle roll contact the ends of the first roll, detecting, with the at least one measuring device, contact between at least one end of the at least one middle roll with at least one end of the first roll using the at least one measuring device, producing the closing signal S when the first nip closes, and recording the pressure in one of the of the internal support devices of the first roll, the internal support devices of the second roll, and the external support devices of the second roll at the instant of the complete closing of the first nip.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
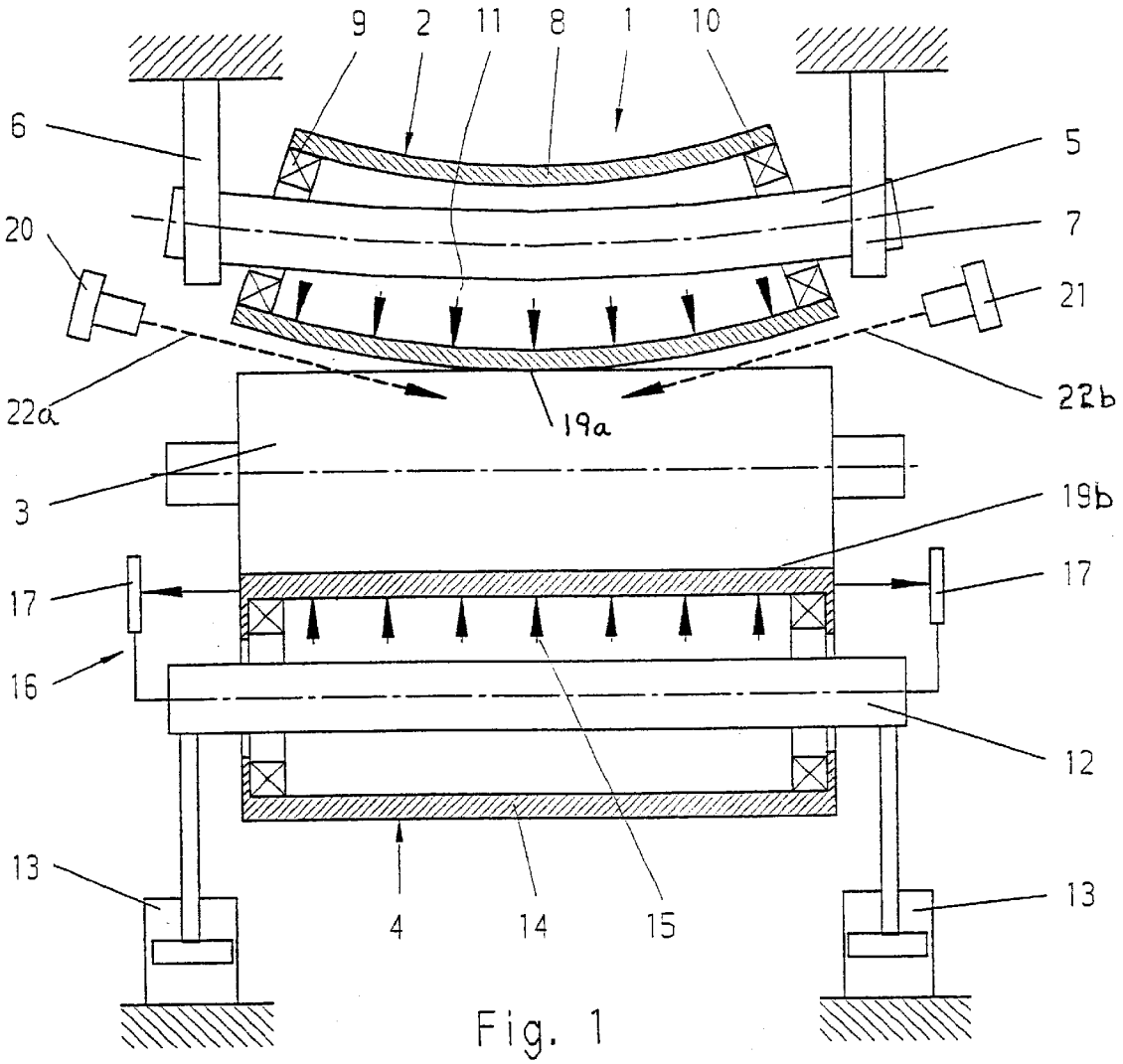
FIG. 1 shows a schematic representation of a calender that can be used according to the invention.

The calender shown in FIG. 1 has a vertical roll stack 1. Roll stack 1 is formed by an upper roll 2, a middle roll 3, and a lower roll 4. Upper roll 2 has a carrier 5 whose ends are rotationally secured in stationary seats 6 and 7. Upper roll 2 also has a jacket 8 whose ends are pivoted on carrier 5 via seats 9 and 10. Jacket 8 is moreover supported on carrier 5 by internal hydraulic support devices 11, represented by pressure arrows. Such a roll may take the form of a sag compensation roll which does not utilize a jacket lift.

The height of middle roll 3 is preferably made adjustable. Moreover, middle roll 3 can be seated on levers which may be pivotal or otherwise moveable, for example. Further, the lowering movement of middle roll 3 may or may not be limited by known stops (not shown) e.g., such as suspension spindles.

A lower roll 4 is provided which has a carrier 12 that is supported at both ends in a rotationally secured manner. Lower roll 4 is designed to be moveable such that its height can be adjusted by, e.g., at least one and preferably at least two external hydraulic support devices 13. A jacket 14 is supported on a carrier 12 via internal hydraulic support devices 15, represented by pressure arrows. Moreover, jacket 14 can be adjusted relative to carrier 12 in the vertical direction. Accordingly, lower roll 4 may take the form of a sag compensation roll having a jacket lift.

A control device 16 is also provided having a measuring device 17 at both ends of carrier 12. Measuring device is utilized to determine the distance between the end of jacket 14 and carrier 12, and ensures that this distance is kept constant.

A nip 19*a* is thus formed between upper roll 2 and middle roll 3. Moreover, at least one other nip 19*b* is formed between middle roll 3 and lower roll 4. One and preferably two measuring devices 20 and 21 are assigned to each of the two ends of nip 19*a*. Measuring devices 20, 21 are designed to deliver a closing signal S at the instant at which nip 19*a* is completely closed. These measuring devices 20, 21 may be designed as light barrier devices whose light beams 22*a*, 22*b* are interrupted at the instant of the closing of the nip, so that a closing signal S is produced or otherwise occurs.

Figure 2:
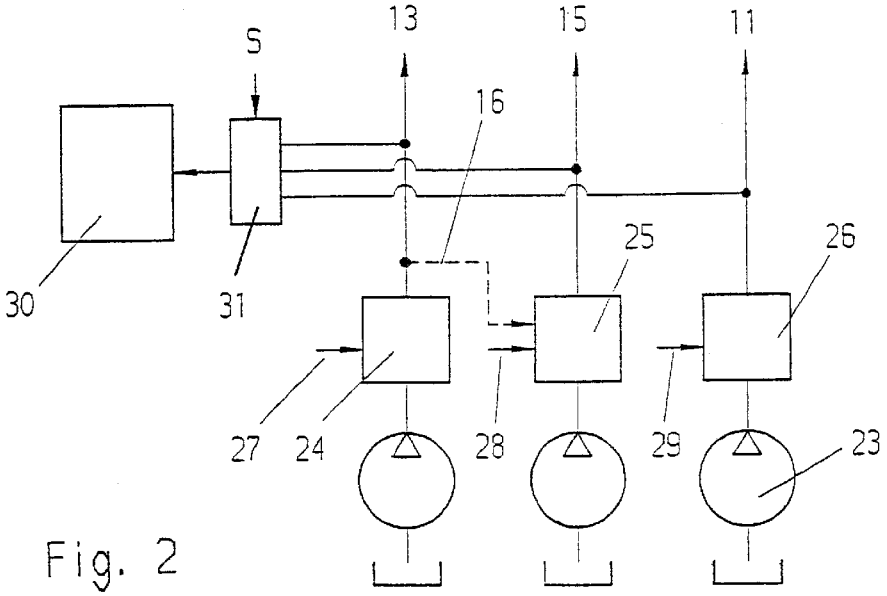
FIG. 2 shows a circuit diagram for applying pressure.

The circuit diagram of FIG. 2 shows a hydraulic pressure source 23, e.g., three pumps and one first control device 24 for the pressures to be applied to external support devices 13, a second control device 25 for the pressures to be applied to internal support devices 15 of lower roll 4, and a third control device 26 for the pressures to be applied to internal support devices 11 of upper roll 2.

Equal pressures are preferably applied to both piston/cylinder units of the external support devices 13 and can be selected by utilizing input 27. Moreover, equal pressures specified by control device 16 can be applied to the individual elements of internal support devices 15. However, these pressures can also be changed during operation via input 28. Additionally, equal pressures specified by input 29 can be applied to the individual elements of internal support devices 11.

A recording device 30 is utilized to record the pressures applied to support devices 11, 13, and 15 that are effective at the instant at which uppermost nip 19*a* closes completely. For this purpose, a blocking element 31 can be situated upstream of recording device 30. In operation, this device can open when the closing signal S is given by measuring devices 20 or 21.

One procedure which may be utilized during the calibration is as follows. One starting point is a roll stack in which all the nips are open. First, pressure is applied to internal support devices 15 of lower roll 4 such that the weight of jacket 14 is compensated for and jacket 14 forms a cylinder having a horizontal axis. Then the pressure in external support devices 13 is increased slowly, whereupon carrier 12 is caused to moved upwards and such that jacket 14 is carried along with the aid of control device 16. Middle roll 3, which is suspended at first, is contacted by lower roll 4, initially in the center and thereafter along its entire length. This procedure is then repeated if and when additional middle rolls are utilized or otherwise present. Finally, as the pressure increases further in external support devices 13, upper roll 2 is contacted in the center by an adjacent middle roll 3. Next, nip 19*a* can be closed by further increasing the pressure in external support devices 13 and/or by decreasing the pressure in internal support devices 11. Accordingly, the closing procedure for nip 19*a* takes place from the center outwards on both sides. At the instant at which light beams 22*a*, 22*b* are interrupted by the closing of the ends of nip 19*a*, the closing signal S is produced which ensures that the pressure values achieved in this way are recorded and thus can be used as a basis for further adjustment.

Since all the rolls can be arranged to run in a precisely horizontal manner at the end of the calibrating procedure, straight nips can be formed everywhere, in which constant conditions prevail across the entire roll width. These conditions can also be maintained even when pressure increases are undertaken uniformly in the internal and/or external support devices 11, 13 and 15. As a result, even when a load that varies by zone is found to be necessary, the recorded pressure values can form a reference base.

It should be noted that the drawings are shown schematically. The internal and external support devices 11, 13, and 15 can preferably have a customary or conventional design. Moreover, middle roll 3 can be equipped in a known manner with agents for compensating for projecting weights. Further, the described procedure is also suitable for calenders whose stacks are inclined to the vertical.

It is noted that the foregoing examples have been provided merely for the purpose of explanation and are in no way to be construed as limiting of the present invention, While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for presetting a calender for a material web, the calender including a roll stack having at least a first nip and a second nip arranged to define a stack plane and comprising a sag compensation lower roll having a rotationally secured carrier which can be moved along the stack plane by external support devices arranged at both ends of the lower roll, the lower roll having a jacket which is supported on the carrier by internal support devices wherein the jacket can be adjusted along its entire length in the direction of the stack, the calender further comprising at least one middle roll which can be adjusted in the stack plane and a sag compensation upper roll having a carrier which is held stationary at its ends and a jacket which supported on the carrier by internal support devices, the jacket being mounted to the carrier at its ends, the process comprising:

applying pressure to the internal support devices of the lower roll such that the jacket of the lower roll approximately forms a cylinder having a horizontal axis;

applying pressure to close each of the first and second nips, the pressure being applied to one of the external support devices of the lower roll and the internal support devices of the lower roll;

recording the pressures on at least one of the internal support devices of the upper roll, the internal support devices of the lower roll, and the external support devices of the lower roll at an instant of a complete closing of the first nip.

2. The process of claim 1, wherein the material web is one of a paper web and a cardboard web and wherein the stack plane is a vertical stack plane with the first nip being arranged above the second nip.

3. The process of claim 1, further comprising recording the pressures in each of the internal support devices of the upper roll, the internal support devices of the lower roll, and the external support devices of the lower roll at the instant of the complete closing of the first nip.

4. The process of claim 1, wherein the pressure applied to the support devices of the lower roll is followed to the pressure applied to the other support devices.

5. The process of claim 1, including applying pressure to the internal support devices of the lower roll and thereafter applying pressure to at least one of the internal support devices of the upper roll and the external support devices of the lower roll.

6. The process of claim 1, further comprising decreasing the pressure applied to the internal support devices of the upper roll in order to close the first nip.

7. The process of claim 1, further comprising applying approximately equal pressure to each of the internal support devices of the upper roll, the internal support devices of the lower roll, and the external support devices of the lower roll.

8. The process of claim 7, wherein the approximately equal pressures are correlated between each of the internal and external support devices.

9. The process of claim 1, further comprising detecting a measuring signal the instant the first nip is closed.

10. The process of claim 9, further comprising changing at least one pressure of the external and internal support devices based upon the detecting.

11. The process of claim 10, wherein the changing comprises automatically changing the pressure when a measuring signal is detected.

12. The process of claim 1, further comprising detecting the closing of the first nip using an optical device.

13. The process of claim 12, wherein the detecting comprises optically detecting at the instant of a complete closing of the first nip.

14. The process of claim 1, further comprising changing the pressure applied to the internal support devices of the lower roll in order to produce a constant distance between jacket ends of the lower roll and the carrier of the lower roll.

15. The process of claim 1, further comprising compensating for a projecting weight of the at least one middle roll.

16. A process of presetting a calender for a material web using a calender including a roll stack defining a stack plane and comprising at least a first and a second nip formed by at least first and second sag compensation rolls with at least one middle roll disposed between the first and second rolls, the first roll comprising a stationary carrier and a jacket supported on the carrier by internal support devices, the jacket being rotatably mounted on the stationary carrier, the at least one middle roll being adjustably moveable along the stack plane, the second roll comprising an adjustably removeable carrier and a jacket supported on the carrier by internal support devices, the carrier being moveable along the stack plane by external support devices, and at least one measuring device arranged to detect the closing of the first nip, wherein the measuring device produces a closing signal S when the first nip closes, the process comprising:

applying pressure to the internal support devices of the second roll such that the jacket of the second roll assumes approximately a cylindrical shape;

applying at least one of pressure to the external support devices and additional pressure to the internal support devices of the second roll in order to cause the second roll to contact the at least one middle roll;

applying at least one of additional pressure to one of the external support devices and the internal support devices of the second roll, wherein the additional pressure causes movement of the at least one middle roll against the first roll such that the center of the middle roll contacts the center of the first roll before the ends of the middle roll contact the ends of the first roll;

detecting, with the at least one measuring device, contact between at least one end of the at least one middle roll with at least one end of the first roll using the at least one measuring device;

producing the closing signal S when the first nip closes; and recording the pressure in one of the internal support devices of the first roll, the internal support devices of the second roll, and the external support devices of the second roll at the instant of the complete closing of the first nip.

* * * * *